US005956007A

United States Patent [19]

Ito et al.

[11] Patent Number: 5,956,007

[45] **Date of Patent: *Sep. 21, 1999**

[54] FRAME MODULATION DRIVING CIRCUIT AND METHOD FOR LIQUID CRYSTAL DISPLAY

[75] Inventors: Takae Ito; Katsunori Tanaka; Satoshi Sekido, all of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/511,281

[22] Filed: Aug. 4, 1995

[30] Foreign Application Priority Data

Aug. 30, 1994 [JP] Japan ..... 6-205199

[51] Int. Cl.[6] ..... G09G 3/36

[52] U.S. Cl. ..... 345/89; 345/149

[58] Field of Search ..... 345/63, 77, 89, 345/147, 148, 149; 358/456

[56] References Cited

U.S. PATENT DOCUMENTS 5,400,044 3/1995 Thomas ..... 345/89
5,412,395 5/1995 Maeda et al. ..... 345/89
5,479,188 12/1995 Moriyama ..... 345/89
5,552,800 9/1996 Uchikoga et al. ..... 345/149

FOREIGN PATENT DOCUMENTS 3-164793 7/1991 Japan ..... G09G 3/36
4-133089 5/1992 Japan ..... G09G 3/36
5-108033 4/1993 Japan ..... G09G 3/36

*Primary Examiner*—Amare Mengistu
*Attorney, Agent, or Firm*—Greer, Burns & Crain Ltd.

[57] ABSTRACT

A driving circuit for driving an LCD, using frame modulation, includes: a data converting circuit for frame modulation having at least two averaged patterns for use in averaging brightness during frame modulation and converting display data using the averaged patterns and a display data detecting circuit for detecting the logical states of at least two leading dots specified in said display data. The data converting circuit for frame modulation controls switching of the at least two averaged patterns according to the result of detection. This configuration makes it possible to substantially prevent the occurrence of flickers irrespective of the display pattern. This contributes to realization of an excellent display.

13 Claims, 23 Drawing Sheets

CASE OF 15 GRAY-SCALE LEVELS

CASE OF 14 GRAY-SCALE LEVELS

Fig. 10

| DISPLAY DATA (GRAY-SCALE) LEVEL | "R" LINE SELECTED VOLTAGE | | "G" LINE SELECTED VOLTAGE | | "B" LINE SELECTED VOLTAGE | |
|---|---|---|---|---|---|---|
| | RF=0 | RF=1 | GF=0 | GF=1 | BF=0 | BF=1 |
| 0 | V0 | V0 | V0 | V0 | V0 | V0 |
| 1 | V1 | V0 | V0 | V1 | V1 | V0 |
| 2 | V1 | V1 | V1 | V1 | V1 | V1 |
| 3 | V2 | V1 | V1 | V2 | V2 | V1 |
| 4 | V2 | V2 | V2 | V2 | V2 | V2 |
| 5 | V3 | V2 | V2 | V3 | V3 | V2 |
| 6 | V3 | V3 | V3 | V3 | V3 | V3 |
| 7 | V4 | V3 | V3 | V4 | V4 | V3 |
| 8 | V4 | V4 | V4 | V4 | V4 | V4 |
| 9 | V5 | V4 | V4 | V5 | V5 | V4 |
| 10 | V5 | V5 | V5 | V5 | V5 | V5 |
| 11 | V6 | V5 | V5 | V6 | V6 | V5 |
| 12 | V6 | V6 | V6 | V6 | V6 | V6 |
| 13 | V5 | V7 | V7 | V5 | V5 | V7 |
| 14 | V6 | V7 | V7 | V6 | V6 | V7 |
| 15 | V7 | V7 | V7 | V7 | V7 | V7 |

Fig.11

| FRAME NUMBER | POSITION OF DISPLAY DATA | | REF. VOLTAGE SELECTING FLAG | | |
|---|---|---|---|---|---|
| | VERTICAL LINE | LATERAL PIXELS | RF | GF | BF |
| EVEN-NUMBER FRAME | EVEN-NUMBER LINE | ■□□□ | 1 | 1 | 0 |
| | | □■□□ | 0 | 1 | 1 |
| | | □□■□ | 0 | 0 | 1 |
| | | □□□■ | 1 | 0 | 0 |
| | ODD-NUMBER LINE | ■□□□ | 0 | 0 | 1 |
| | | □■□□ | 1 | 0 | 0 |
| | | □□■□ | 1 | 1 | 0 |
| | | □□□■ | 0 | 1 | 1 |
| ODD-NUMBER FRAME | EVEN-NUMBER LINE | ■□□□ | 0 | 0 | 1 |
| | | □■□□ | 1 | 0 | 0 |
| | | □□■□ | 1 | 1 | 0 |
| | | □□□■ | 0 | 1 | 1 |
| | ODD-NUMBER LINE | ■□□□ | 1 | 1 | 0 |
| | | □■□□ | 0 | 1 | 1 |
| | | □□■□ | 0 | 0 | 1 |
| | | □□□■ | 1 | 0 | 0 |

Fig.12

| FRAME NUMBER | POSITION OF DISPLAY DATA | | REF. VOLTAGE SELECTING FLAG | | |
|---|---|---|---|---|---|
| | VERTICAL LINE | LATERAL PIXELS | RF | GF | BF |
| EVEN-NUMBER FRAME | EVEN-NUMBER LINE | ■□□□ | 1 | 1 | 1 |
| | | □■□□ | 1 | 1 | 1 |
| | | □□■□ | 1 | 1 | 1 |
| | | □□□■ | 1 | 1 | 1 |
| | ODD-NUMBER LINE | ■□□□ | 0 | 0 | 0 |
| | | □■□□ | 0 | 0 | 0 |
| | | □□■□ | 0 | 0 | 0 |
| | | □□□■ | 0 | 0 | 0 |
| ODD-NUMBER FRAME | EVEN-NUMBER LINE | ■□□□ | 0 | 0 | 0 |
| | | □■□□ | 0 | 0 | 0 |
| | | □□■□ | 0 | 0 | 0 |
| | | □□□■ | 0 | 0 | 0 |
| | ODD-NUMBER LINE | ■□□□ | 1 | 1 | 1 |
| | | □■□□ | 1 | 1 | 1 |
| | | □□■□ | 1 | 1 | 1 |
| | | □□□■ | 1 | 1 | 1 |

CASE OF "R", "G", "B", DATA=1

Fig.13a

EVEN-NUMBER FRAME

| | FIRST PIXEL | | | SECOND PIXEL | | | THIRD PIXEL | | | FOURTH PIXEL | | | |
|---|---|---|---|---|---|---|---|---|---|---|---|---|---|
| | R | G | B | R | G | B | R | G | B | R | G | B | R |
| 1 | V0 | V0 | V1 | V1 | V0 | V0 | V1 | V1 | V0 | V0 | V1 | V1 | V0 |
| 2 | V1 | V1 | V0 | V0 | V1 | V1 | V0 | V0 | V1 | V1 | V0 | V0 | V1 |
| 3 | V0 | V0 | V1 | V1 | V0 | V0 | V1 | V1 | V0 | V0 | V1 | V1 | V0 |
| 4 | V1 | V1 | V0 | V0 | V1 | V1 | V0 | V0 | V1 | V1 | V0 | V0 | V1 |

Fig.13b

ODD-NUMBER FRAME

| | R | G | B | R | G | B | R | G | B | R | G | B | R |
|---|---|---|---|---|---|---|---|---|---|---|---|---|---|
| 1 | V1 | V1 | V0 | V0 | V1 | V1 | V0 | V0 | V1 | V1 | V0 | V0 | V1 |
| 2 | V0 | V0 | V1 | V1 | V0 | V0 | V1 | V1 | V0 | V0 | V1 | V1 | V0 |
| 3 | V1 | V1 | V0 | V0 | V1 | V1 | V0 | V0 | V1 | V1 | V0 | V0 | V1 |
| 4 | V0 | V0 | V1 | V1 | V0 | V0 | V1 | V1 | V0 | V0 | V1 | V1 | V0 |

CASE OF "R", "G", "B", DATA=0, 1, 0, 1

SWITCHING OF AVERAGED PATTERN

FIRST PIXEL | SECOND PIXEL | THIRD PIXEL | FOURTH PIXEL

Fig.14a

EVEN-NUMBER FRAME

| | R | G | B | R | G | B | R | G | B | R | G | B | R |
|---|---|---|---|---|---|---|---|---|---|---|---|---|---|
| 1 | V0 | V0 | V0 | V1 | V0 | V0 | V0 | V0 | V0 | V0 | V0 | V0 | V0 |
| 2 | V0 | V0 | V0 | V0 | V1 | V1 | V0 | V0 | V0 | V1 | V1 | V1 | V0 |
| 3 | V0 | V0 | V0 | V1 | V0 | V0 | V0 | V0 | V0 | V0 | V0 | V0 | V0 |
| 4 | V0 | V0 | V0 | V0 | V1 | V1 | V0 | V0 | V0 | V1 | V1 | V1 | V0 |

Fig.14b

ODD-NUMBER FRAME

| | R | G | B | R | G | B | R | G | B | R | G | B | R |
|---|---|---|---|---|---|---|---|---|---|---|---|---|---|
| 1 | V0 | V0 | V0 | V0 | V1 | V1 | V0 | V0 | V0 | V1 | V1 | V1 | V0 |
| 2 | V0 | V0 | V0 | V1 | V0 | V0 | V0 | V0 | V0 | V0 | V0 | V0 | V0 |
| 3 | V0 | V0 | V0 | V0 | V1 | V1 | V0 | V0 | V0 | V1 | V1 | V1 | V0 |
| 4 | V0 | V0 | V0 | V1 | V0 | V0 | V0 | V0 | V0 | V0 | V0 | V0 | V0 |

R.O.F. : MAX 3.3 %

R.O.F. : MAX 3.3 %

R.O.F. : MAX 1.7 %

R.O.F. : MAX 1.9 %

FRAME MODULATION DRIVING CIRCUIT AND METHOD FOR LIQUID CRYSTAL DISPLAY

BACKGROUND OF THE INVENTION

1. Field of the Invention

The present invention relates to a liquid-crystal display (hereinafter LCD), more particularly, to an art for controlling the gray-scale level data required for achieving a gray-scale display on an active matrix type LCD in which frame modulation is implemented.

2. Description of the Related Art

With the advent of an LCD permitting multiple gray-scale displays, there is a growing demand for an increase in the number of gray-scale levels. Means for expressing gray scale are classified into an analog technique and a digital technique in terms of a driver for driving a liquid-crystal panel.

The analog technique is such that drive voltage is varied and amplified in analog form and then applied to a liquid crystal. An analog signal is handled as it is. The analog technique has the advantages that no limitation is imposed on the number of gray-scale levels, and that full-color display can be achieved. A drawback of the analog technique is that, since numerous operational amplifiers are needed, the circuitry is complex and the power consumption is relatively high.

The digital technique is such that one of a plurality of reference voltages fed to a driver for driving a liquid-crystal panel is selected and applied to a liquid crystal. Compared with the analog technique, the digital technique has simple internal configuration. An IC used as a driver can therefore be manufactured at low cost. However, the number of internal elements increases with an increase in the number of gray-scale levels. The number of signals fed externally and the number of supplied reference voltages increase accordingly. This poses a problem in that the number of gray-scale levels (that is, the number of display colors) is relatively small.

A frame modulation technique has been used as a means for increasing the number of display gray-scale levels without increasing the amount of voltage associated with gray-scale levels and handled by a digital driver. In frame modulation, a drive voltage that differs among a plurality of frames is applied to pixels (that is a liquid crystal) in order to make intermediate brightnesses discernible. According to this technique, the number of gray-scale levels can be increased relatively effortlessly. FIGS. 1*a* to 1*c* show an example of the frame modulation technique. FIG. 1*a* shows a waveform of voltage to be applied to a liquid crystal for 15-level gray-scale display. FIG. 1*b* shows a waveform of voltage to be applied to a liquid crystal for 14-level gray-scale display. In the case of FIG. 1*a*, the fifteen gray-scale levels correspond to different drive voltage levels; +7, +6, etc., 0, etc., −6, and −7 V. In the case of FIG. 1*b*, the fourteen gray-scale levels correspond to different drive voltage levels; +7, +6, etc., 0, etc., −5, and −6 V. FIG. 1*c* shows a change in brightness relative to drive voltage.

According to a conventional frame modulation technique, flickers triggered by the display of a specific display pattern pose a significant problem. The flickers are attributable to the fact that when a pixel potential differs among frames, the transmittance of a liquid-crystal panel varies to bring about a change in brightness.

For driving a liquid-crystal panel, a lateral line inversion driving method, a vertical line inversion driving method, or a dot inversion driving method for handling adjoining dots has been adopted in an effort to eliminate flickers. These driving methods are devised because a liquid crystal must be driven with alternating voltage. Mention will be made of a liquid-crystal panel on the assumption that thin film transistors (hereinafter TFTs) are used to construct the liquid-crystal panel.

In the TFT type liquid-crystal panel shown in FIG. 2*a* (in FIG. 2*a*, Q denotes a transistor), even if a voltage having the same level in both positive and negative directions as shown in FIG. 2*b* (which is comparable to a drain potential of the TFT) is applied, a pixel potential (comparable to a source potential of the TFT) shifts to the negative side due to the capacitance $C_{GS}$ of a parasitic element. Even if the potential of an opposed electrode CEL is regulated, the drive voltage cannot be retained at either positive or negative polarity at all the pixels. This causes flickers. In FIG. 2*a*, SL denotes a scan line, DL denotes a data line linked to the drain of each TFT, $C_{LC}$ denotes the capacitance in a liquid crystal which shall be called liquid-crystal capacitance and P denotes the equivalent of pixel electrodes with a liquid crystal between them.

For suppressing the occurrence of flickers attributable to the capacitance of a parasitic element, it is useful to reverse the polarity of the writing voltage for each dot (pixel). When a large area of a liquid-crystal panel is viewed, it is seen that a difference in brightness between frames is averaged. Thus, the occurrence of flickers is suppressed. In the aforesaid lateral line inversion or vertical line inversion driving, the polarity of the writing voltage is reversed for each lateral line or vertical line. In dot inversion driving, the polarity of the writing voltage is reversed, in a zigzag form, for each dot.

As far as a normal display pattern used for character display or non-periodic graphic display is concerned, the aforesaid driving methods pose no problem. However, when a specific display pattern used for a periodic graphic display or for the display of many vertical and lateral straight lines, flickers occur.

As shown as an example in FIG. 3, when data having a display pattern coincident with the reversal in polarity of the drive (writing) voltage from the upper and lower drivers is displayed, since the logical states of rendered dots specified in the data (or the polarities of glowing pixels) are the same, the brightness is not averaged. This causes flickers. This display pattern will be referred to as a "same-polarity pattern" for convenience.

Frame modulation is a technique for varying a pixel potential (voltage applied to a liquid crystal) intentionally from frame to frame. When a high voltage is applied to all pixels associated with dots during a first frame and low voltage is applied to all the pixels during a second frame, a difference in brightness occurs between the first and second frames. An approach for coping with this problem is to average the brightness by mixing high voltages and low voltages during each frame. A pattern according to which the brightness is averaged will be referred to as an "averaged pattern" for convenience.

As in the same-polarity pattern, when the averaged pattern is consistent with a display pattern as shown in FIG. 4, flickers occur. Even if the averaged patterns are changed periodically, the periodicity is discernible as flickers to the human eye.

As mentioned above, in an LCD using known frame modulation, the occurrence of flickers cannot be avoided relative to a certain dot array specified by display data.

SUMMARY OF THE INVENTION

An object of the present invention is to provide a device and method for driving an LCD such that, whatever display pattern is handled by an LCD using frame modulation, the device can substantially prevent the occurrence of flickers and realize an excellent display.

According to a first aspect of the present invention, there is provided a driving circuit for driving a liquid-crystal display using frame modulation, comprising: a data converting circuit for frame modulation having at least two averaged patterns for use in averaging brightness during the frame modulation and converting display data using the averaged patterns; and a display data detecting circuit for detecting the logical states of two leading dots specified in the display data; based on the result of the detection, the at least two averaged patterns being switched.

According to a second aspect of the present invention, there is provided a method of driving a liquid crystal display using frame modulation, comprising the steps of: detecting the logical states of at least two leading dots specified in input display data and supplying a detection signal; converting the input display data into data used for frame modulation and supplying frame-modulation data to be displayed according to the detection signal; and applying a required drive voltage to liquid-crystal display elements according to the frame-modulation data.

BRIEF DESCRIPTION OF THE DRAWINGS

Other objects and features of the present invention will be described hereinafter, in detail, by way of preferred embodiments with reference to the accompanying drawings, in which:

FIG. 10 shows the relationship between display data and selected reference voltages;

FIG. 11 shows the relationship between pixel locations and selected reference voltages relative to a normal display pattern;

FIG. 12 shows the relationship between pixel locations and selected reference voltages relative to a specific display pattern;

FIGS. 13*a* and 13*b* are explanatory diagrams showing displayed states of data having normal display patterns;

FIGS. 14*a* and 14*b* are explanatory diagrams showing displayed states of data having specific display patterns;

DESCRIPTION OF THE PREFERRED EMBODIMENTS

FIGS. 5*a* to 5*f* show examples of the principle of an LCD driving method in accordance with the present invention.

Figure 5A:
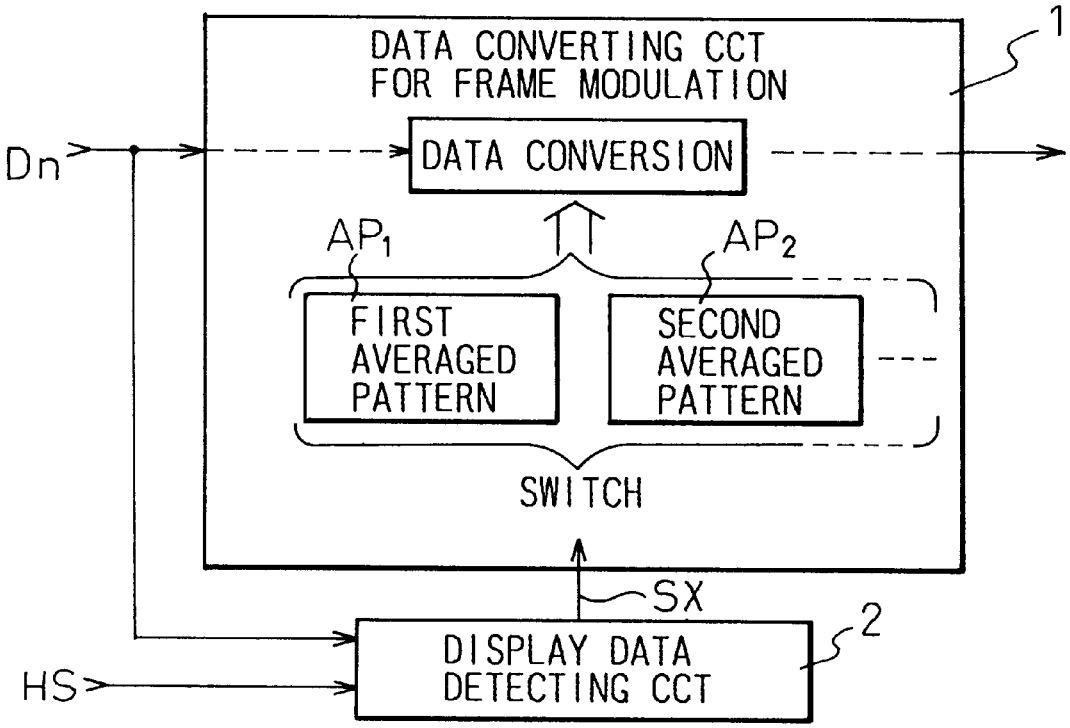
FIGS. 5*a* to 5*f* are explanatory diagrams concerning the principle of an LCD driving circuit in accordance with the present invention.
Figure 5B:
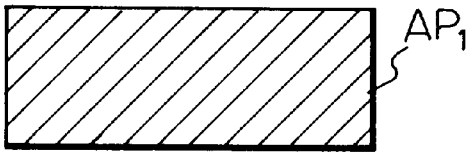
Figure 5C:
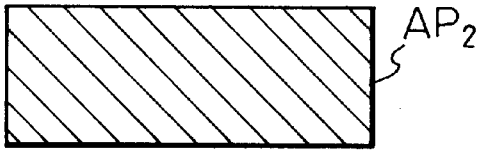

FIG. 5*a* shows the configuration of an LCD driving circuit in accordance with the present invention. In FIG. 5*a*, reference numeral 1 denotes a data converting circuit for frame modulation. The data converting circuit 1 contains at least the two averaged patterns used to average the brightness for frame modulation (for brevity's sake, the first and second averaged patterns $AP_1$ and $AP_2$ alone are shown in FIGS. 5*b* and 5*c*), and has the ability to convert display data Dn using the averaged patterns. 2 denotes a display data detecting circuit. The display data detecting circuit 2 has the ability to detect the on or off states of pixels associated with at least two dots specified in the display data Dn. Based on the result SX of detection made by the display data detecting circuit 2, switching of at least two averaged patterns $AP_1$ and $AP_2$ is controlled.

Figure 5D:
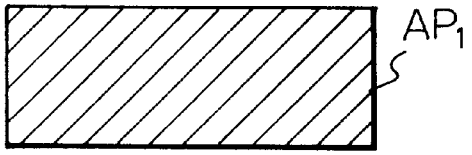
Figure 5E:
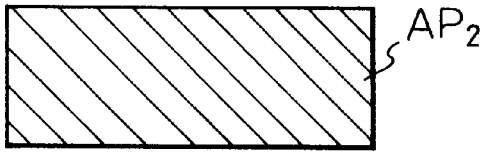
Figure 5F:
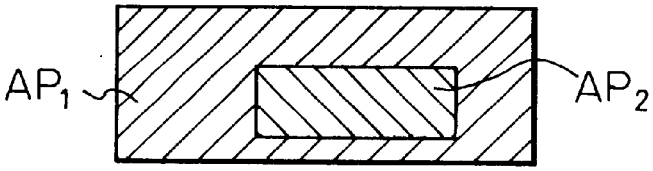

According to the present invention, when display data having a normal display pattern is input, the first averaged pattern $AP_1$ is used to perform frame modulation (See FIG. 5*d*). For display data having a specific display pattern and being prone to a drawback such as flickers or irregular brightness, the second averaged pattern $AP_2$ which suppresses the drawback relative to the pattern of the display data is selected (See FIG. 5*e*) according to the operation of the display data detecting circuit 2.

When input of the display data having a specific display pattern has been completed, the first averaged pattern $AP_1$ is automatically selected. In whatever place in a display screen the display data is displayed, since the display data is averaged according to the second averaged pattern $AP_2$ (See FIG. 5*f*), an excellent display, unaffected with flickers or irregular brightness, is realized.

Figure 6:
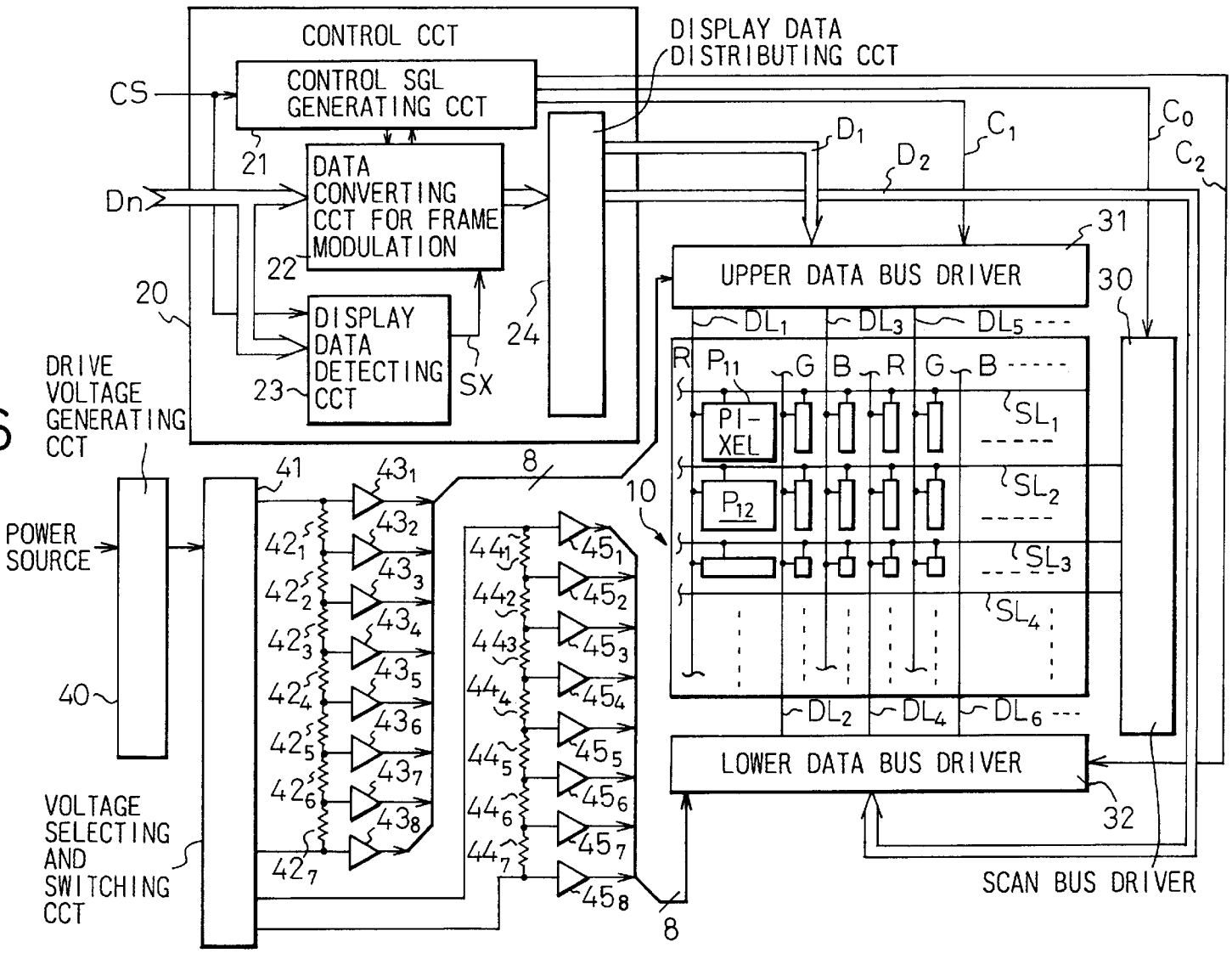
FIG. 6 shows the configuration of an LCD in accordance with an embodiment of the present invention.

FIG. 6 shows the configuration of an LCD in accordance with an embodiment of the present invention.

In this embodiment, an active matrix type TFT LCD is driven using a digital technique. A vertical line inversion driving method is implemented in the TFT LCD using upper and lower drivers each handling the different voltage levels associated with eight gray-scale levels and also using frame modulation.

Figure 1A:
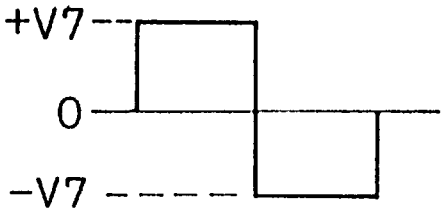
PRIOR ART Fig.1a
FIGS. 1*a* to 1*c* are explanatory diagrams concerning a frame modulation technique.
Figure 1B:
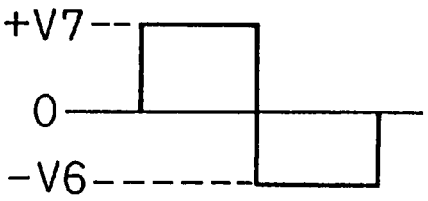
PRIOR ART Fig.1b
Figure 1C:
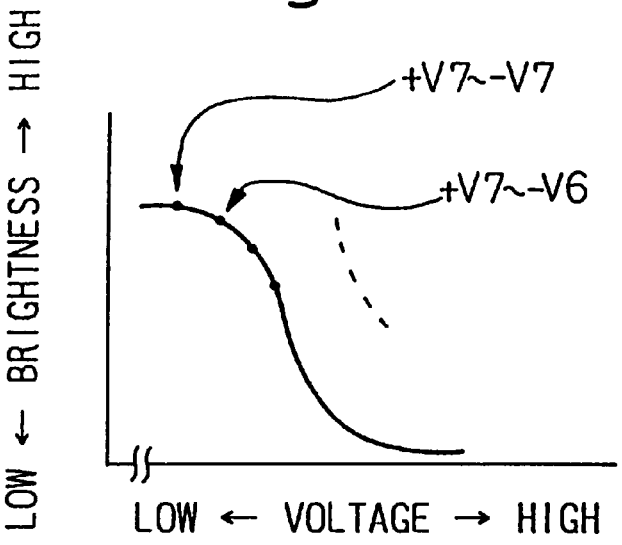
PRIOR ART Fig.1c
Figure 2A:
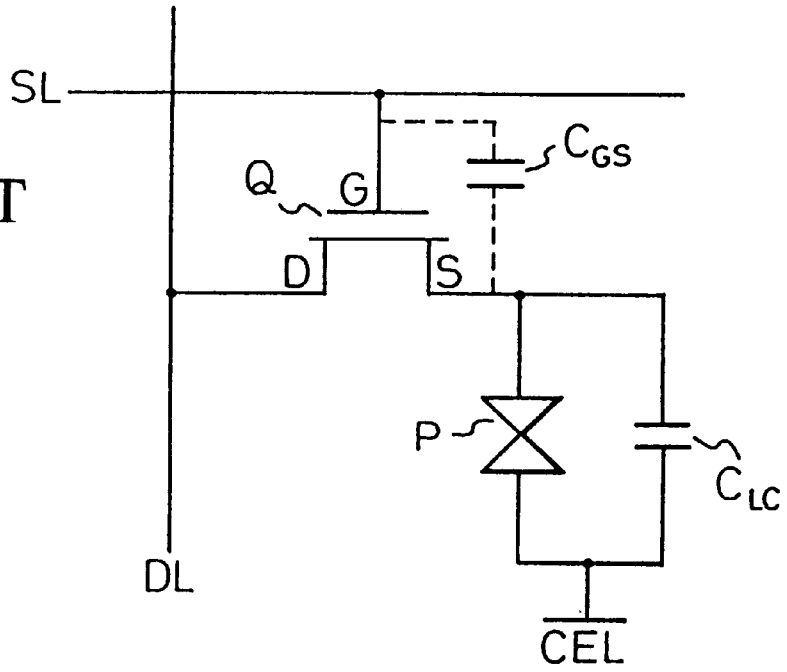
PRIOR ART Fig.2a
FIGS. 2*a* to 2*c* show the circuitry of one pixel in a typical TFT LCD and the relationship between writing voltage and pixel voltage.
Figure 2B:
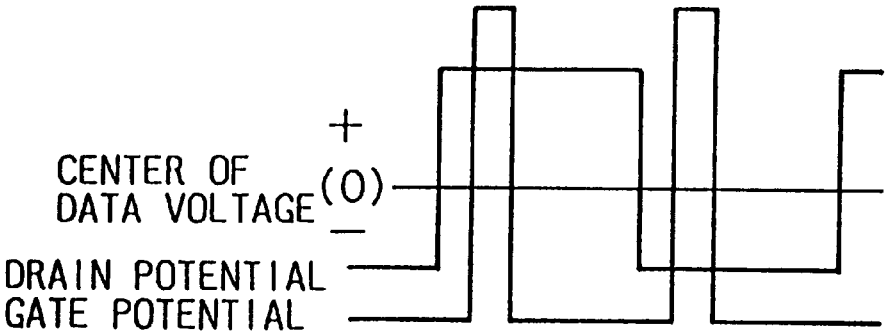
Fig.2b PRIOR ART
Figure 2C:
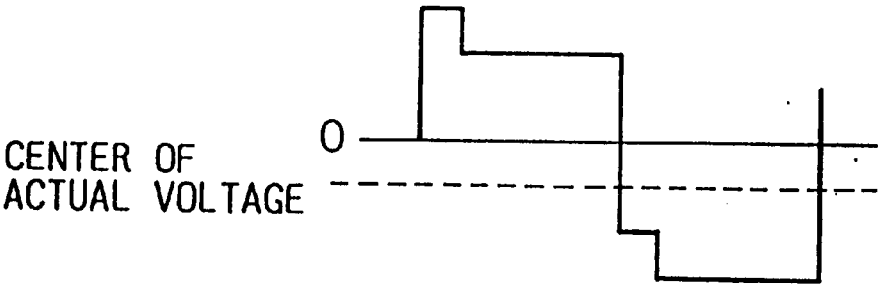
Fig.2c PRIOR ART
Figure 3:
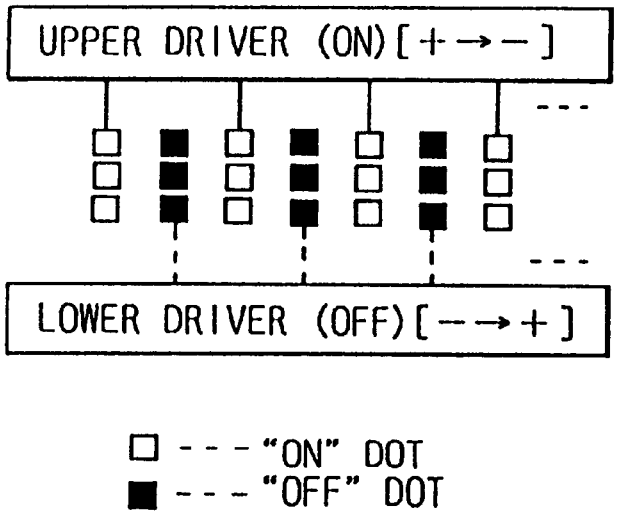
PRIOR ART Fig.3
FIG. 3 is an explanatory diagram concerning flickers occurring when a same-polarity pattern is handled.
Figure 4:
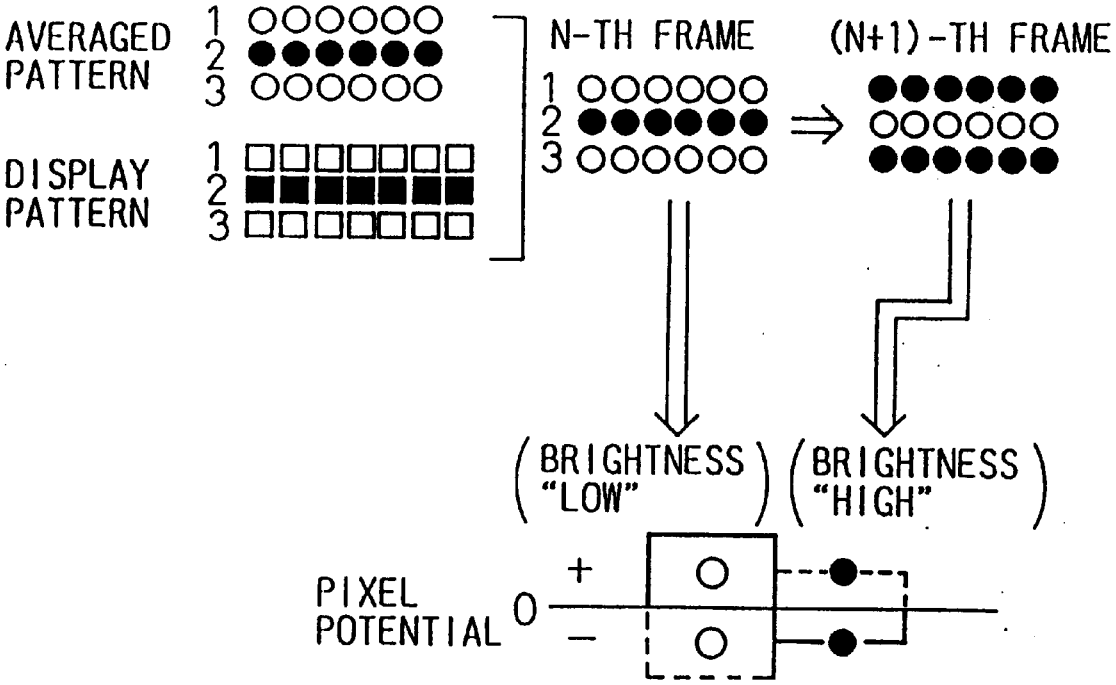
PRIOR ART Fig.4
FIG. 4 is an explanatory diagram concerning flickers occurring when an averaged pattern is used.

In FIG. 6, reference numeral 10 denotes a liquid-crystal panel. $P_{ij}$ (where i or j=1, 2, etc.) denotes the smallest display unit referred to as a "pixel." Pixels $P_{ij}$ are situated at intersections between a plurality of data lines $DL_i$ (where i=1, 2, etc.) and a plurality of scan lines $SL_j$ (where j=1, 2, etc.) which are arranged in the form of a matrix. Each pixel $P_{ij}$ has the circuitry shown in FIG. 2*a*; that is, each pixel $P_{ij}$ is composed of a TFT (transistor Q in FIG. 2*a*), which, when an associated scan line $SL_j$ is selected, transmits a voltage representing display data over an associated data line $DL_i$, and a liquid-crystal capacitor (capacitor $C_{LC}$ in FIG. 2*a*) for storing voltage information transmitted by the TFT. In the liquid-crystal panel 10, pixels lying laterally (in the same direction as a scan line) are thought to constitute a display line (or lateral line). Voltage representing data to be displayed on an LCD is applied in units of one lateral line. Pixels lying vertically (in the same direction as a data line) are thought to constitute a vertical line.

Reference numeral 20 denotes a control circuit for controlling the whole of the LCD. The control circuit 20 has the ability to provide various kinds of control for applying voltages representing display data Dn to pixels or displaying the data Dn in response to the display data Dn or a control signal CS (including a dot clock, horizontal synchronizing signal, vertical synchronizing signal, clear signal, and frame control signal which are fed in synchronization with the display data Dn) which are fed externally. The control circuit 20 includes a driver control signal generating circuit 21 for generating various control signals $C_0$, $C_1$, and $C_2$ required for driving the liquid-crystal panel 10 via drivers that will be described later, a data converting circuit 22 for frame modulation that uses a plurality of averaged patterns designed for frame modulation to convert input display data Dn, a display data detecting circuit 23 for detecting the on or off states of pixels constituting one display (lateral) line and corresponding to a given number of dots specified in the display data in response to the control signal CS and display data Dn, and then for generating a control signal SX for use in switching the averaged patterns, and a display data distributing circuit 24 for classifying the display data Dn into upper display data $D_1$ or lower display data $D_2$ representing a given polarity.

Reference numeral 30 denotes a scan bus driver for consecutively driving scan lines $SL_1$, $SL_2$, etc. in the liquid-crystal panel 10 in response to the control signal $C_0$. 31 denotes an upper data bus driver for consecutively driving data lines $DL_1$, $DL_3$, $DL_5$, etc. in the liquid-crystal panel 10 in response to the control signal $C_1$, upper display data $D_1$, and reference voltage which assumes eight voltage levels and will be described later. 32 denotes a lower data bus driver for driving data lines $DL_2$, $DL_4$, $DL_6$, etc. in the liquid-crystal panel 10 in response to the control signal $C_2$, lower display data $D_2$, and reference voltage which assumes eight voltage levels and will be described later. In this embodiment, the upper data bus driver 31 and lower data bus driver 32 are situated up and down so that the output lines of each driver will be lined up in the form of comb teeth. Depending on a driving method, either of the upper and lower drivers alone will do.

Reference numeral 40 denotes a drive voltage generating circuit for generating a plurality of drive voltages to be applied to the data lines $DL_1$ on receipt of a power supply. 41 denotes a voltage selecting and switching circuit for selecting any of a plurality of generated drive voltages or switching the plurality of drive voltages. $\mathbf{42}_1$ to $\mathbf{42}_7$ denote resistors for providing eight fractional voltages or eight voltages whose voltage levels are fractions of a difference in voltage level between two selected drive voltages. $\mathbf{45}_1$ to $\mathbf{45}_6$ denote operational amplifiers for amplifying the fractional voltages and providing reference voltages of eight different voltage levels for the lower data bus driver 32.

Each of the upper and lower data bus drivers 31 and 32 is composed of a shift register, first and second memories each having the capacity of N bits (where N denotes the number of bits constituting display data Dn), decoder, and selector, and constructed as an integrated circuit normally. Among these circuit elements, the shift register starts operating in response to a start signal (control signals $C_1$ and $C_2$) supplied from the driver control signal generating circuit 21 for each lateral line, shifts data bits synchronously with a clock (control signals $C_1$ and $C_2$) supplied from the driver control signal generating circuit 21, and then produces a timing signal. The upper display data $D_1$ supplied from the display data distributing circuit 24 is placed in the first memory in response to the timing signal. After data is placed in the first memory, data in the first memory is transferred into the second memory in response to the timing signal (control signals $C_1$ and $C_2$) supplied from the driver control signal generating circuit 21 before data associated with the next lateral line comes along. The decoder decodes digital data accumulated in the second memory. The selector selects any of the eight reference voltages of different voltage levels, which are fed via the operational amplifiers $\mathbf{43}_1$ to $\mathbf{43}_8$ or $\mathbf{45}_1$ to $\mathbf{45}_8$. That is to say, the selector acts as a kind of D/A converter for generating an analog signal that is proportional to digital data accumulated in the second memory. As mentioned above, any of the eight reference voltages of different levels is selected, and supplied to the data lines $DL_1$, $DL_3$, $DL_5$, etc., or the data lines $DL_2$, $DL_4$, $DL_6$, etc.

The scan bus driver 30 includes a shift register and drivers associated with the scan lines $SL_1$, $SL_2$, $SL_3$, etc. Among the circuit elements not shown in FIG. 6, the shift register starts operating in response to a start signal (control signal $C_0$) supplied from the driver control signal generating circuit 21, shifts data bits synchronously with a clock (control signal $C_0$) supplied from the driver control signal generating circuit 21, and generates consecutive signals for use in driving TFTs in pixels constituting one lateral line in the liquid-crystal panel 10. The start signal has the same cycle as the vertical synchronizing signal. The clock has the same cycle as the horizontal synchronizing signal HS. The drivers act as binary output circuits each of which determines a voltage level allowing TFTs to go on or off according to the output of the shift register, and applies voltage of the voltage level to an associated scan line. Thus, the gate voltages of the TFTs serving as analog switches are controlled in order to turn on or off the switches. Consequently, voltages of display data signals applied onto the data lines $DL_1$, $DL_2$, $DL_3$, $DL_4$, etc. by the data bus drivers 31 and 32 can be accumulated in the liquid-crystal capacitors lying along each lateral line via TFTs.

Figure 7:
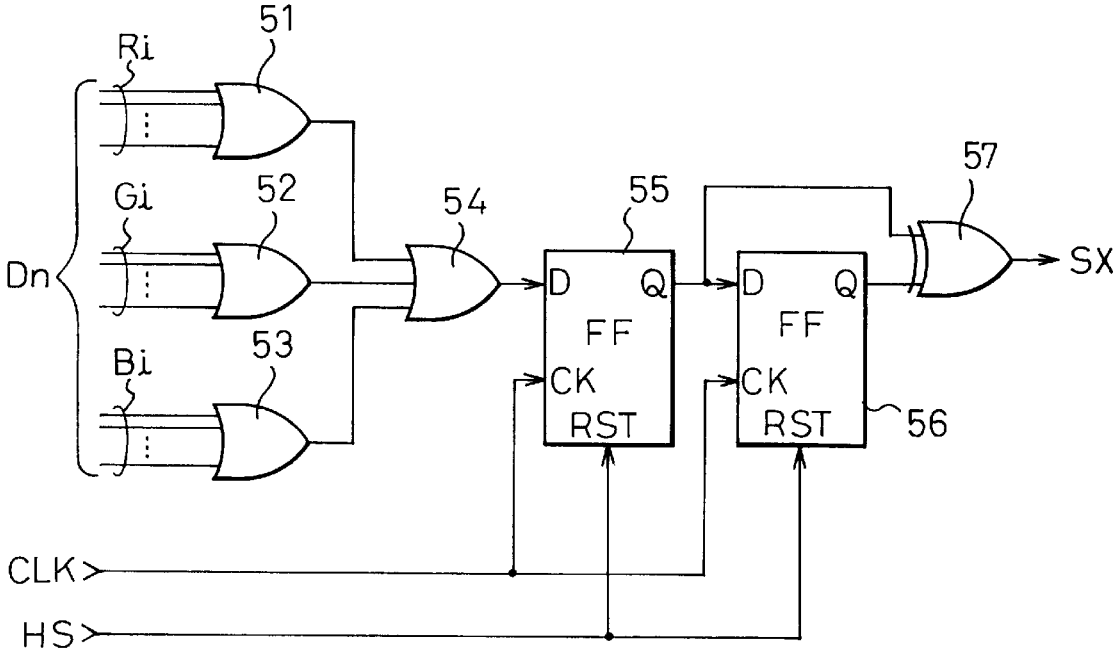
FIG. 7 is a circuit diagram showing an example of the configuration of a display data detecting circuit in FIG. 6.

FIG. 7 shows an example of the circuitry of the display data detecting circuit 23.

The circuit illustrated comprises an OR gate 51 responsive to red display data Ri of display data Dn, an OR gate 52 responsive to green display data Gi of the display data Dn, an OR gate 53 responsive to blue display data Bi of the display data Dn, an OR gate 54 responsive to the outputs of the OR gates 51 to 53, a delay flip-flop (hereinafter D-FF) 55 for latching and providing the output of the OR gate 54 in response to a clock CLK, a D-FF 56 for latching and providing the output (output Q) of the D-FF 55 in response to the clock CLK, and an exclusive OR gate 57 for providing the aforesaid averaged pattern switching control signal SX in response to the outputs of the D-FFs 55 and 56. The D-FFs 55 and 56 are reset in response to a horizontal synchronizing signal HS. The clock CLK can be produced internally by computing the cycle of the horizontal synchronizing signal HS, and therefore need not always be supplied externally.

FIGS. 8*a* to 8*d* show the averaged patterns employed in this embodiment and the switching of the averaged patterns.

In the drawings, white dots or black dots demonstrate voltages at pixels associated with dots displayed with the same gray-scale level, and constitute an averaged pattern as a whole. White dots represent high voltages, while black dots represent low voltages. The voltages are concerned with the N-th frame. For the next (N+1)-th frame, the white dots represent low voltages and the black dots represent high voltages.

Figure 8A:
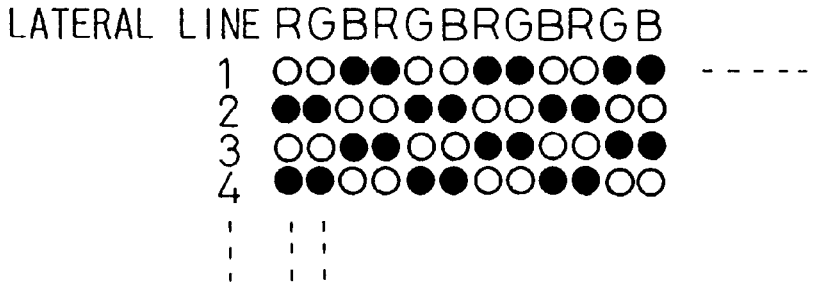
FIGS. 8*a* to 8*d* are explanatory diagrams showing averaged patterns employed in an embodiment of the present invention and the switching of the patterns.
Figure 8B:
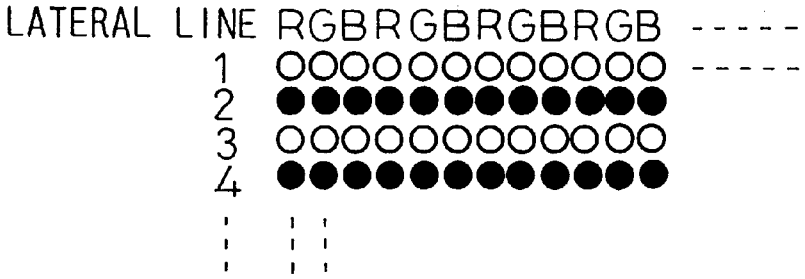

As shown in FIGS. 8*a* and 8*b*, the first averaged pattern is a zigzag pattern according to which voltage levels are changed at every two pixels. The second averaged pattern is a lateral stripe pattern according to which voltage levels are changed on every other lateral line. The zigzag (first averaged) pattern according to which voltage levels are changed at every two pixels is effective for almost all specific display patterns in terms of flickers because high voltages and low voltages are mixed along both a vertical line and lateral line.

However, when the zigzag averaged pattern according to which voltage levels are changed at every two pixels is used to display data having a zigzag pattern according to which voltage levels are changed at every other pixel, voltage levels at adjacent glowing pixels become mutually consistent periodically in the direction of a vertical line. This results in weak irregular brightness. As for displaying data having a zigzag pattern according to which voltage levels are changed at every two pixels, since the zigzag pattern is consistent with the first averaged pattern, flickers occur.

In this embodiment, the display data detecting circuit 23 (See the circuitry of FIG. 7) is used to monitor the on or off states of two leading pixels that lie on the same display line (lateral line) and that are associated with dots specified in display data Dn. When the pixels are changed from the on states to the off states (or vice versa), the display data detecting circuit 23 provides an averaged pattern switching control signal SX. Based on the control signal SX, the data converting circuit 22 for frame modulation switches averaged patterns designed for frame modulation from the first averaged pattern to the second averaged pattern. The second averaged pattern is used to convert the display data Dn. When two leading pixels situated on the same display line and associated with dots specified in the display data has different states, it is conceivable that the display data has a zigzag display pattern according to which voltage levels are changed at every other pixel or a vertical stripe display pattern according to which voltage levels are changed on every other vertical line.

In this embodiment, a lateral stripe pattern (See FIG. 8*b*), according to which voltage levels are changed on every other lateral line, is used as a second averaged pattern. Even when display data has either a zigzag pattern according to which voltage levels are changed at every other pixel or a stripe pattern according to which voltage levels are changed on every other vertical line, occurrence of faults including flickers and irregular brightness can be avoided. In the examples shown in FIGS. 8*c* and 8*d*, averaged patterns are changed relative to display data having a zigzag pattern according to which voltage levels are changed at every other pixel.

In this embodiment, if part (corresponding to lines 1 and 2 in FIG. 8*c*) of the display data may cause a fault when processed with the zigzag averaged pattern (first averaged pattern) according to which voltage levels are changed at every two pixels, the zigzag averaged pattern is switched to the lateral stripe pattern (second averaged pattern) according to which voltage levels are changed on every other lateral line. Since display is controlled in this way, an excellent display unaffected by flickers or irregular brightness can be realized.

The second averaged pattern shown in FIG. 8*b*; that is, a stripe pattern according to which voltage levels are changed on every other lateral line is effective for an LCD in which the vertical line inversion driving method is implemented as in the embodiment shown in FIG. 6. However, the second averaged pattern is ineffective for an LCD in which the lateral line inversion driving method is implemented. That is to say, as far as this kind of LCD is concerned, when the second averaged pattern is a lateral stripe pattern according to which voltage levels are changed on every other lateral line (See FIG. 8*b*), the second averaged pattern is consistent with a polarity reversion pattern. As a result, flickers occur.

Figure 9A:
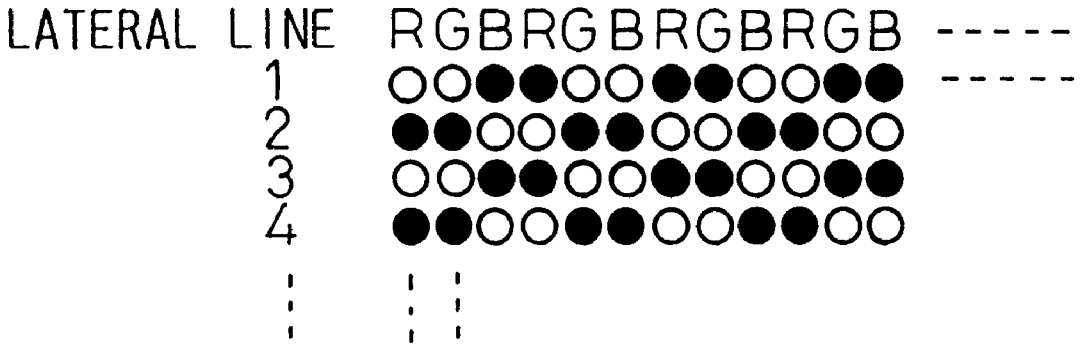
FIGS. 9*a* to 9*b* are explanatory diagrams concerning averaged patterns employed in another embodiment of the present invention.
Figure 9B:
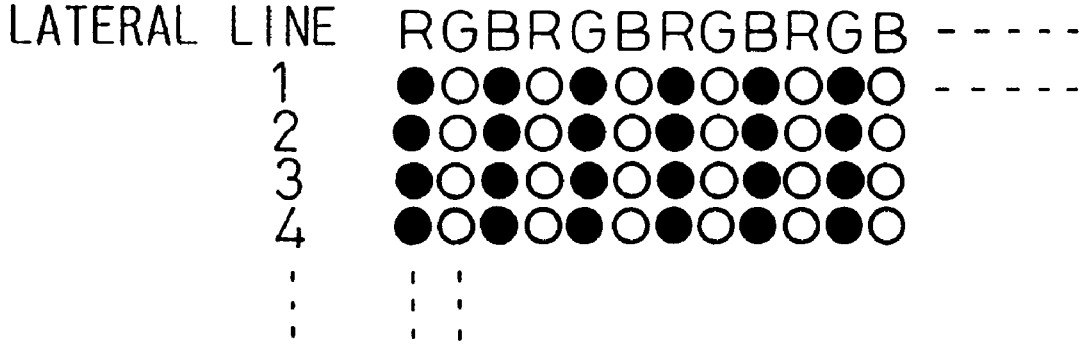

An LCD in which the lateral line inversion driving method is employed is provided as another embodiment of the present invention. As shown in FIGS. 9*a* (first averaged pattern) and 9*b* (second averaged pattern), the second averaged pattern is designed as a vertical stripe pattern according to which voltage levels are changed on every other vertical line. The second averaged pattern will therefore not coincide with a polarity reversion pattern. This results in excellent display unaffected by flickers or irregular brightness.

FIG. 10 shows the relationship between display data and the selected reference voltage.

In FIG. 10, numerals 0 to 15 in the column of display data denote gray-scale levels specified in data. Voltage levels are determined in one-to-one correspondence with sixteen gray-scale levels for each color (red, green, and blue).

In the aforesaid LCD of the embodiment, a driver capable of providing voltages of different levels associated with eight gray-scale levels is used. Reference voltages of different levels associated with eight gray-scale levels, which are supplied during one frame, are combined with those supplied during the next frame, whereby sixteen gray-scale levels are realized. As far as red is concerned, voltage levels associated with RF=0 are combined with voltage values associated with RF=1. Depending on whether a flag RF in the data converting circuit is set to 0 or 1, the reference voltages to be selected are changed.

FIG. 11 shows the relationship between pixel locations and selected reference voltages with respect to a normal display pattern.

Figure 8C:
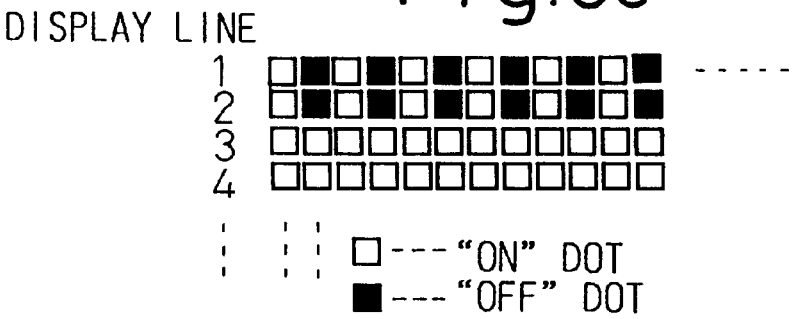
Figure 8D:
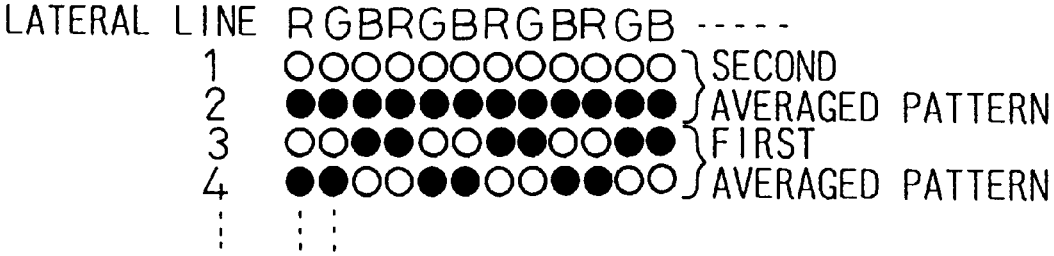

The example in FIG. 11 is concerned with a normal display pattern (equivalent to lines 3 and 4 in FIG. 8*c*). For each pixel associated with a dot that is a combination of red, green, and blue, the flags RF, GF, and BF are set to 1 or 0.

In FIG. 11, since display data has a normal display pattern, logic levels 1 and 0 are changed at every two adjoining pixels situated on either an even-number line or odd-number line. Thus, a first zigzag averaged pattern is effected.

FIG. 12 shows the relationship between pixel locations and the selected reference voltages with respect to a specific display pattern.

In the example illustrated, display data has a specific display pattern (comparable to lines 1 and 2 in FIG. 8*c*). Vertical straight lines are arranged at every other dot in the display data.

For this example, the flags RF, GF, and BF are all set to 1 or 0 for the same line. The values of the flags RF, GF, and BF are different between even-number and odd-number lines. Thus, a second averaged pattern of a lateral stripe pattern is effected. That is to say, a selected gray-scale level is changed on every other lateral line.

FIGS. 13*a* and 13*b* show examples of normal display patterns.

In the examples, voltage representing display data that specifies gray-scale level 1 is applied to all pixels in a panel (that is, a normal display pattern).

As illustrated, when all the pixels in a panel glow, the first averaged pattern that is a zigzag pattern is effected so that two adjoining dots will have the same gray-scale level. Gray-scale levels are different between even-number and odd-number frames.

FIGS. 14*a* and 14*b* show examples of specific display patterns.

In the examples, data is displayed according to a specific display pattern of a vertical stripe pattern (all the first and third odd pixels lying vertically do not glow so that associated dots have gray-scale level 0, and all the second and fourth even pixels lying vertically glow so that associated dots have gray-scale level 1).

As illustrated, the display data detecting circuit checks two dots associated with the first and second pixels, and detects that display data has a specific display pattern according to which glowing and not glowing pixels exist alternately on a vertical line (that is, a vertical straight line is displayed at every other dot position). Based on the result of detection, the first averaged pattern of a zigzag type that has been used for applying voltage to the first and second pixels is switched to the second averaged pattern to be used for applying voltage to the third pixel and thereafter.

As for a vertical line containing the fourth pixel that is glowing, a lateral stripe pattern according to which the same gray-scale level is specified on every other lateral line is effected. Thus, the occurrence of flickers is prevented relative to a specific display pattern.

As mentioned above, occurrence of flickers is attributable to a difference between the positive and negative voltages which are applied to pixels. The voltage difference varies depending on the potential of an opposed electrode (comparable to an element CEL in FIG. 2*a*). The Voltage applied actually to a liquid crystal has a voltage value corresponding to a difference between a potential of a pixel (source potential of a TFT in FIG. 2*a*) and a potential of an opposed electrode. The potential of an opposed electrode is usually set to a value permitting maximum contrast. The set value is not always optimal from the viewpoint of flickers.

FIGS. 15*a* to 15*d* show changes in flicker occurrence rate with respect to values that can be set as the potential of an opposed electrode. For the example in FIG. 15*a*, the potential is set to any value associated with 13 gray-scale levels. For the example in FIG. 15*b*, the potential is set to any value associated with nine gray-scale levels. For the example in FIG. 15*d*, the potential is set to any value associated with five gray-scale levels.

In the illustrated examples, the flicker occurrence rate (in the drawings, R.O.F. standing for the rate of occurrence of flickers) is graphically plotted on the assumption that an LCD adopts the vertical line inversion driving method, that a zigzag pattern according to which voltage levels are changed at every two pixels is used as an averaged pattern, and that display data has a same-polarity pattern. The flicker occurrence rate is a ratio of an alternating component of a luminance signal transmitted by liquid crystal to a direct component thereof, and is expressed as (alternating component/direct component×100%).

Figure 15A:
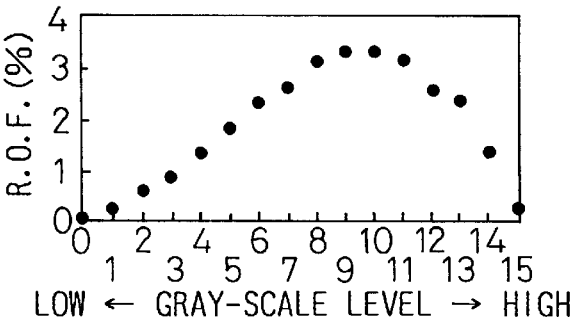
FIGS. 15*a* to 15*d* show changes in flicker occurrence rate relative to voltage levels set for an opposed electrode.
Figure 15B:
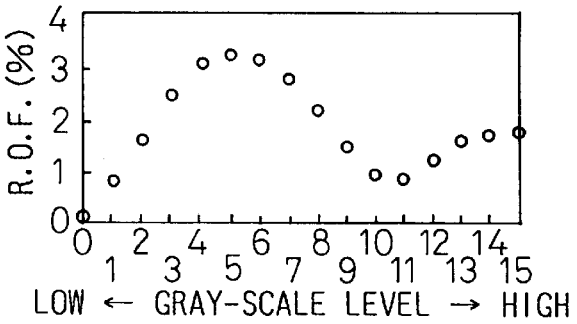
Figure 15C:
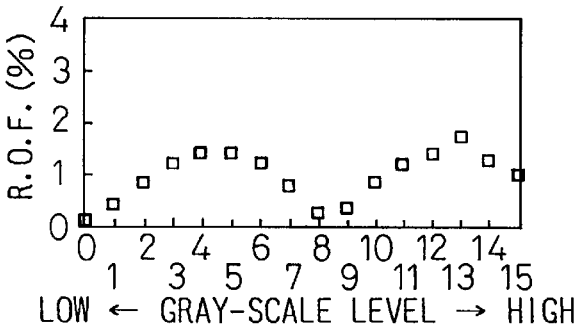
Figure 15D:
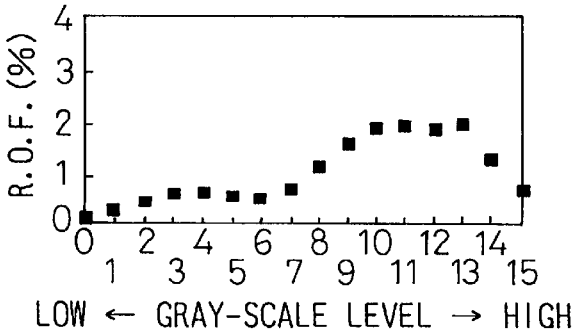

As apparent from FIGS. 15*a* to 15*d*, even if the potential of an opposed electrode is set to a value offering a minimum flicker occurrence rate for each gray-scale level, flicker occurrence rates associated with all gray-scale levels are different from one another. In the example of FIG. 15*c*, the potential of an opposed electrode is determined so that a minimum flicker occurrence rate will be associated with a middle level among nine gray-scale levels. This results in the lowered flicker occurrence rates associated with all gray-scale levels.

Finally, examples of practical circuitry for producing various control signals and display data employed in this embodiment are shown for reference in FIGS. 16*a* to 16*k* and FIGS. 16*p* to 16*v*.

These circuits are incorporated respectively in the driver control signal generating circuit 21, data converting circuit 22 for frame modulation, and display data detecting circuit 23 in the control circuit 20 shown in FIG. 6. In the drawings, terminals each shaped like a triangle are external terminals. FRC denotes a frame control signal for use in effecting frame modulation. DK denotes a dot clock. HS denotes a horizontal synchronizing signal. VS denotes a vertical synchronizing signal. Ri, Gi, and Bi denote signals representing red, green, and blue display data. CLEAR denotes a clear signal.

Figure 16A:
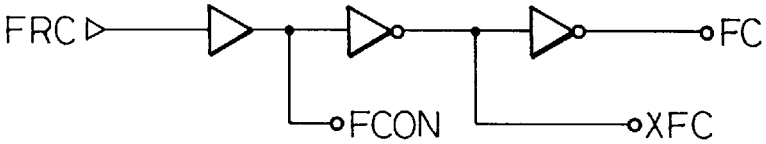
FIGS. 16*a* to 16*k* and FIGS. 16*p* to 16*v* are circuit diagrams showing practical circuit designs for producing various control signals and display data.
Figure 16B:
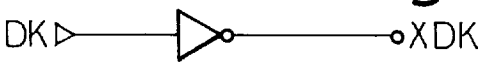
Figure 16C:
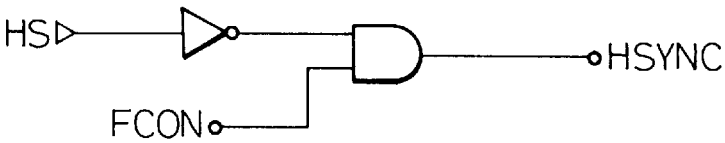
Figure 16D:
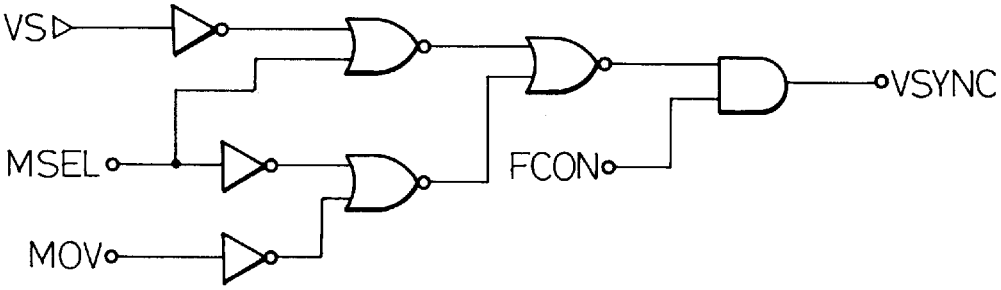
Figure 16E:
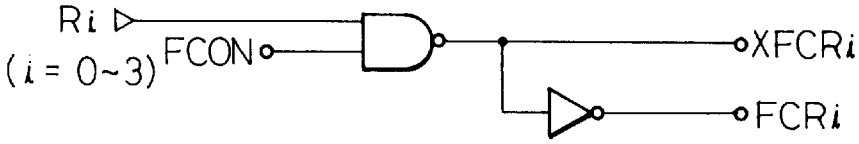
Figure 16F:
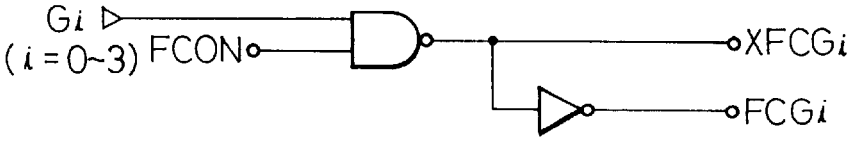
Figure 16G:
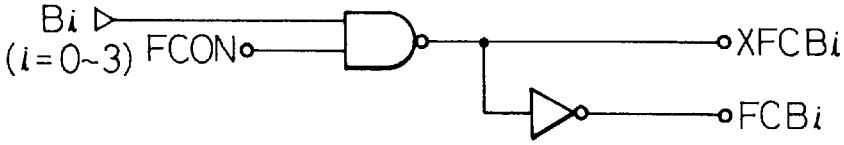
Figure 16H:
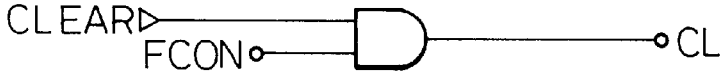
Figure 16I:
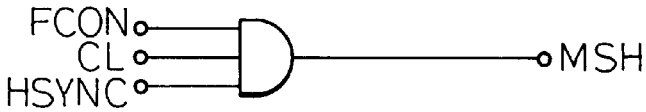
Figure 16J:
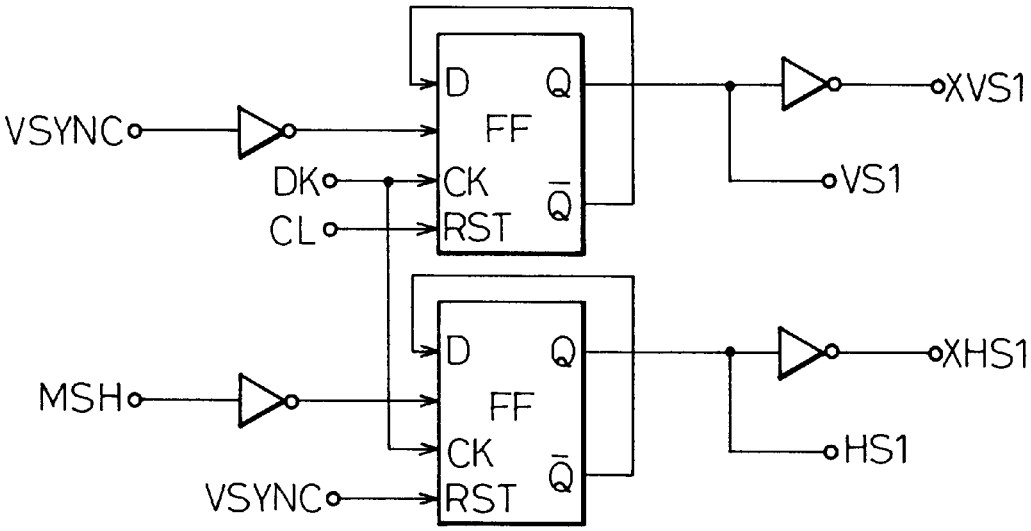
Figure 16K:
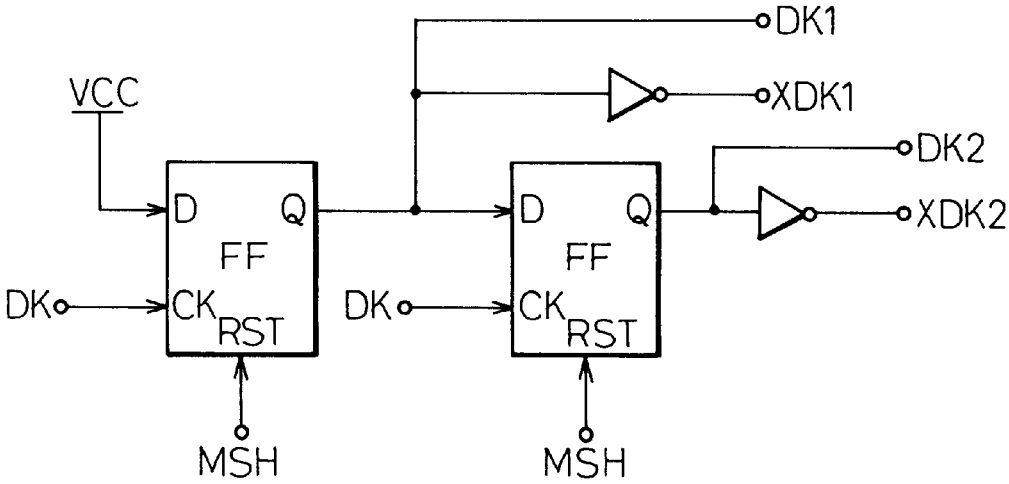
Figure 16P:
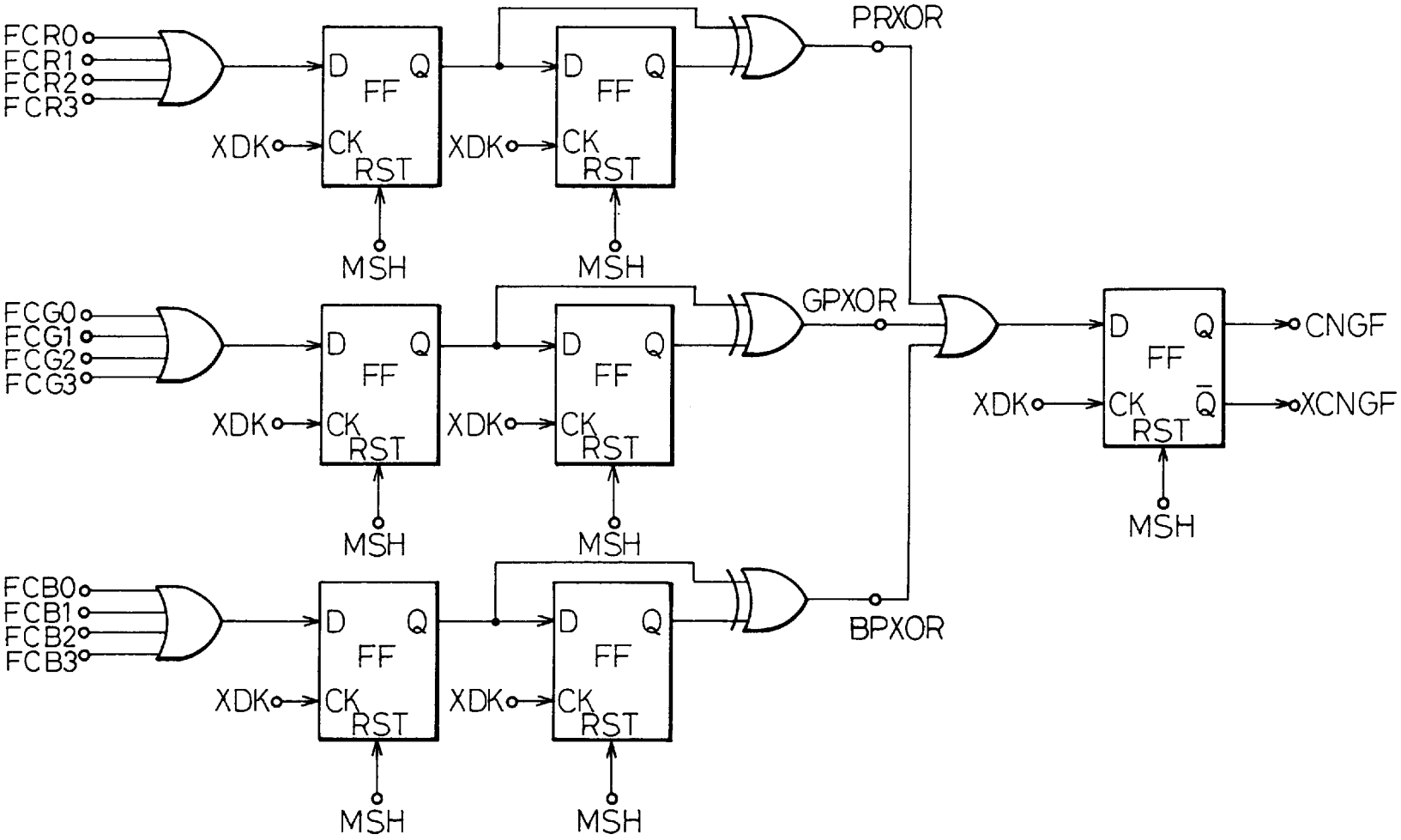
Figure 16Q:
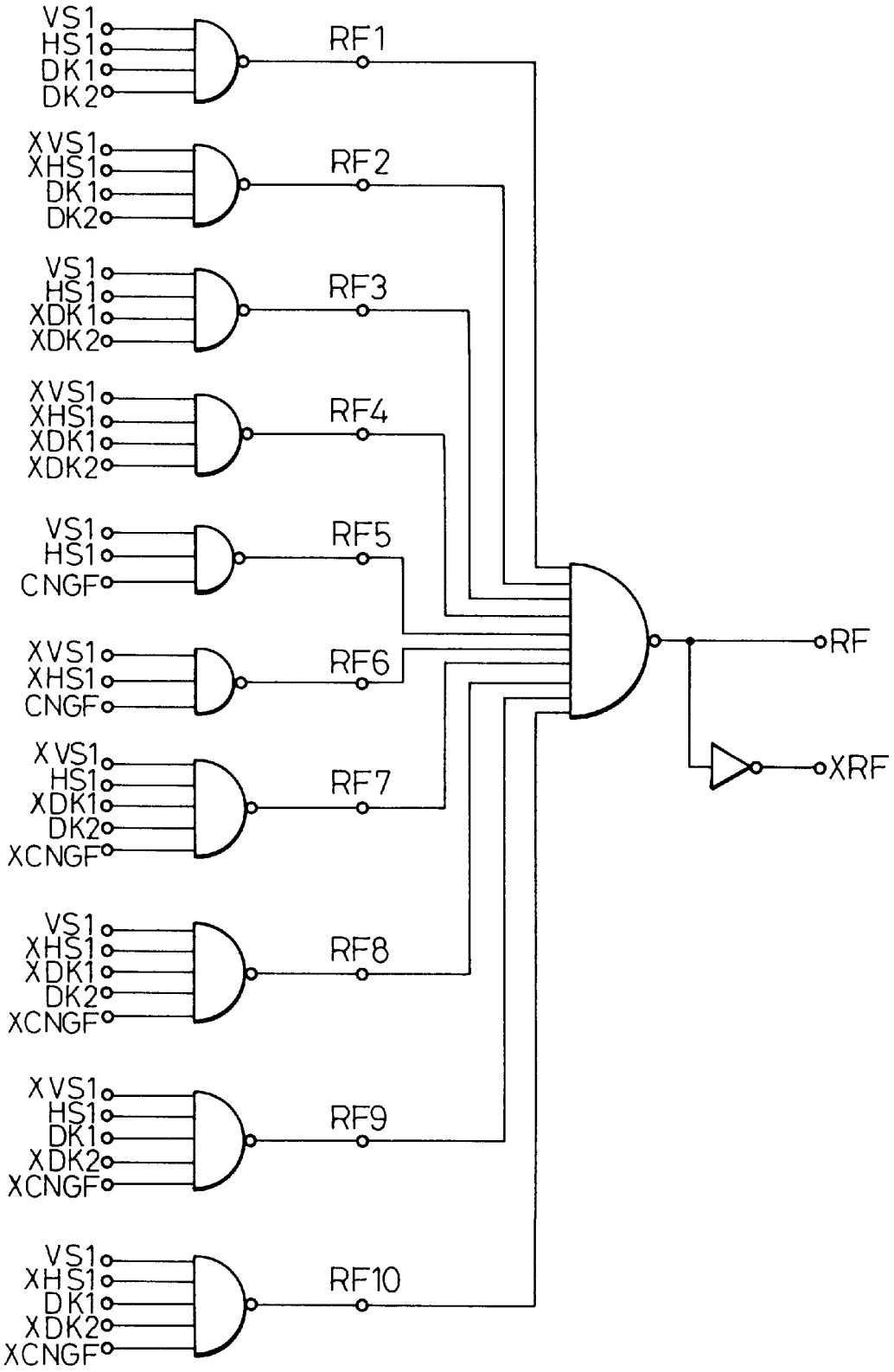
Figure 16R:
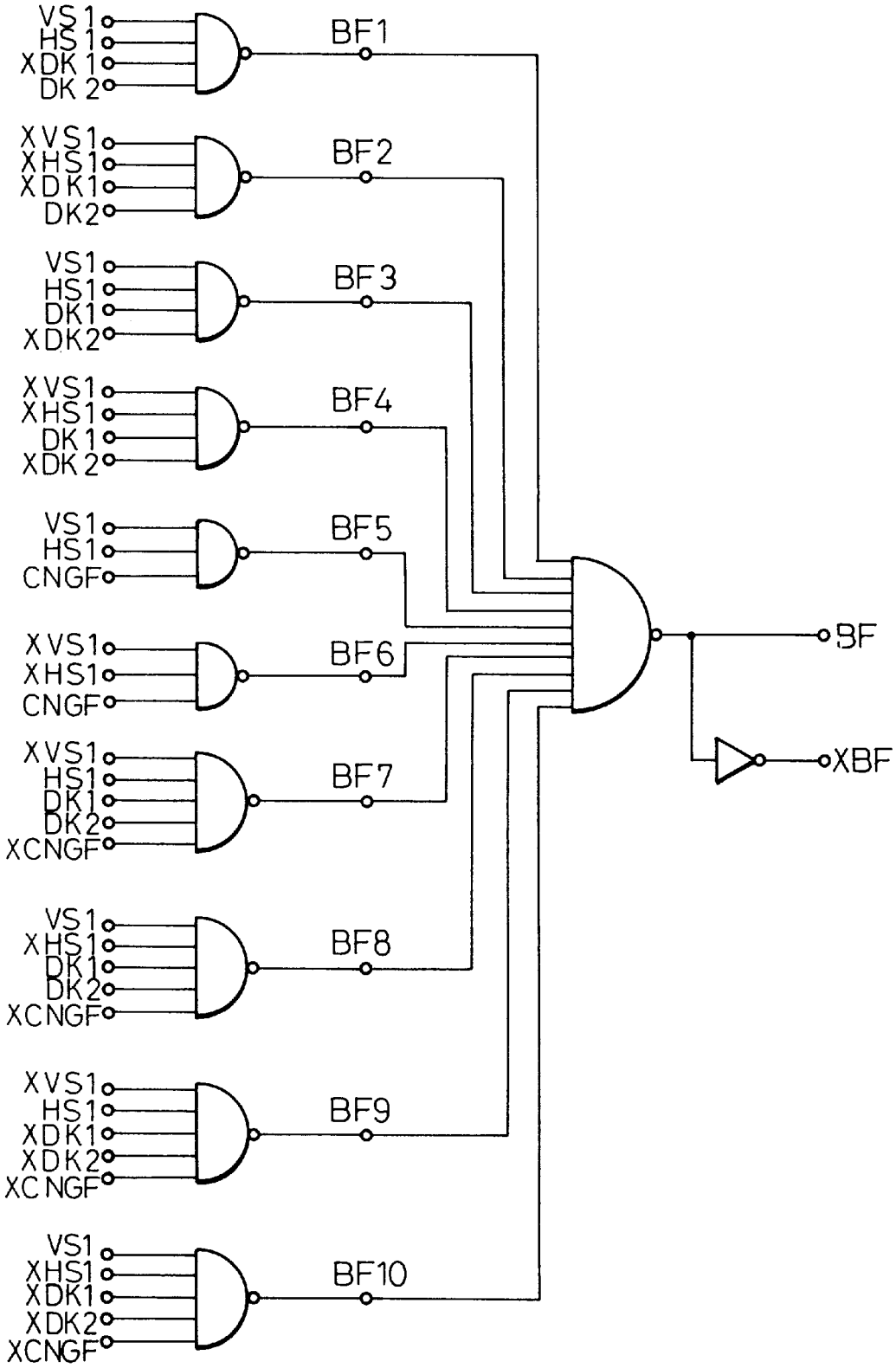
Figure 16S:
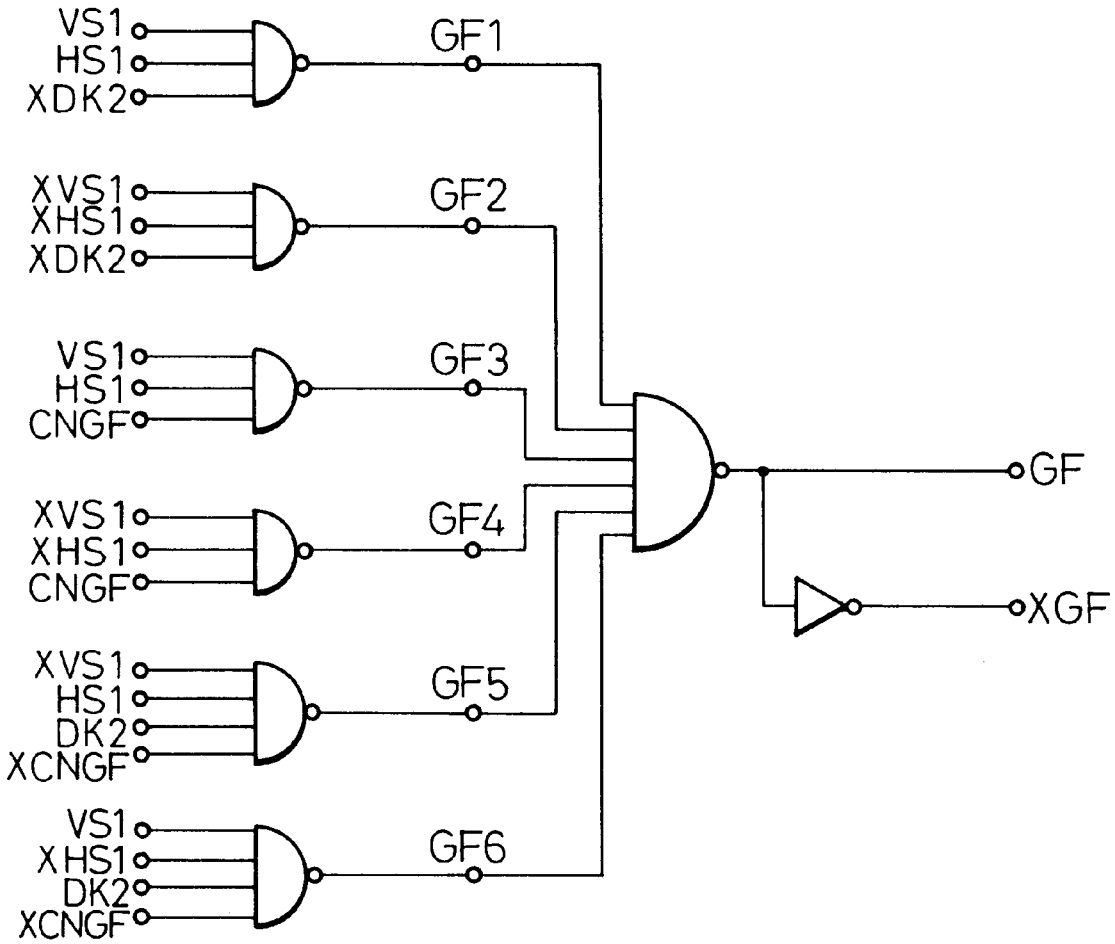
Figure 16T:
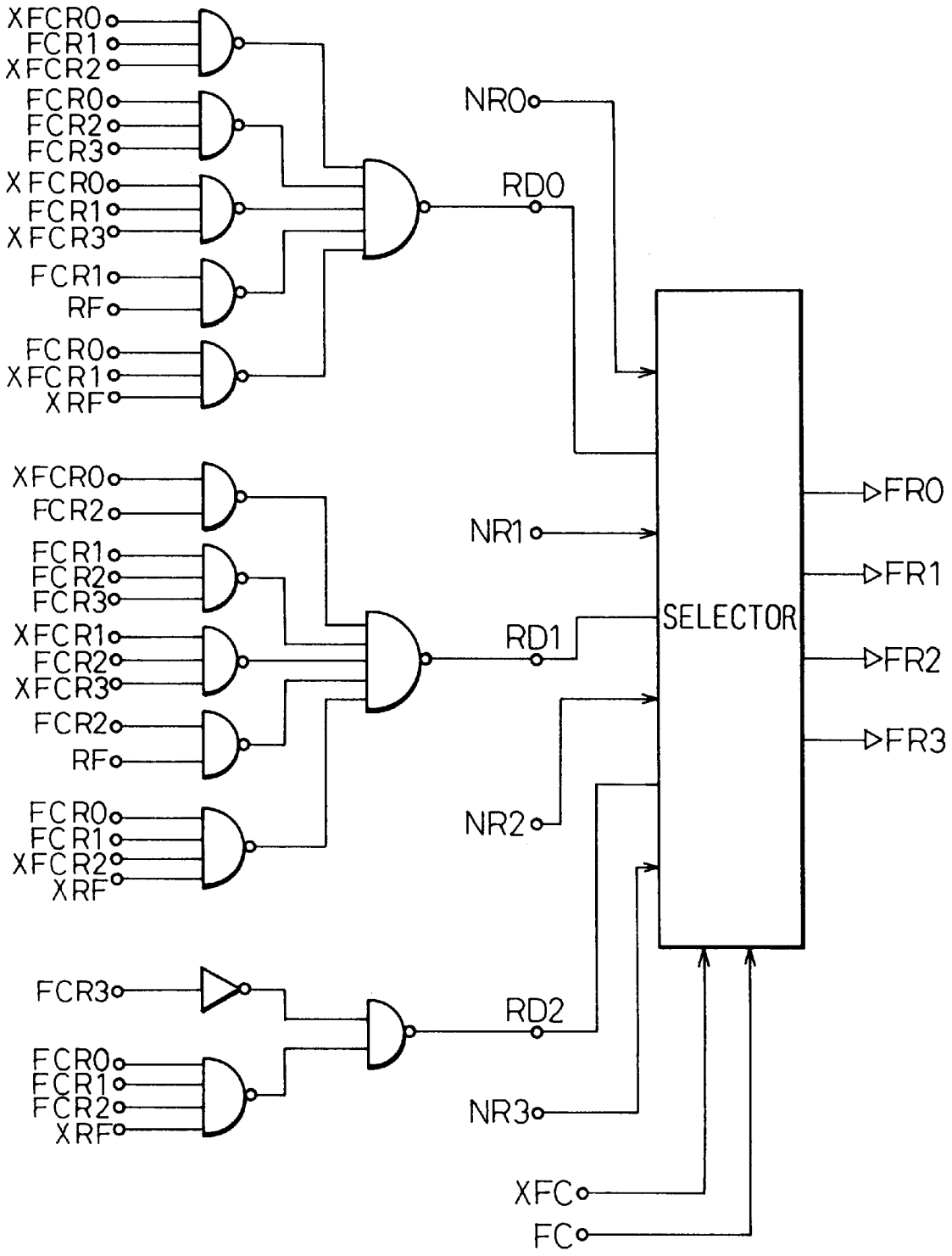
Figure 16U:
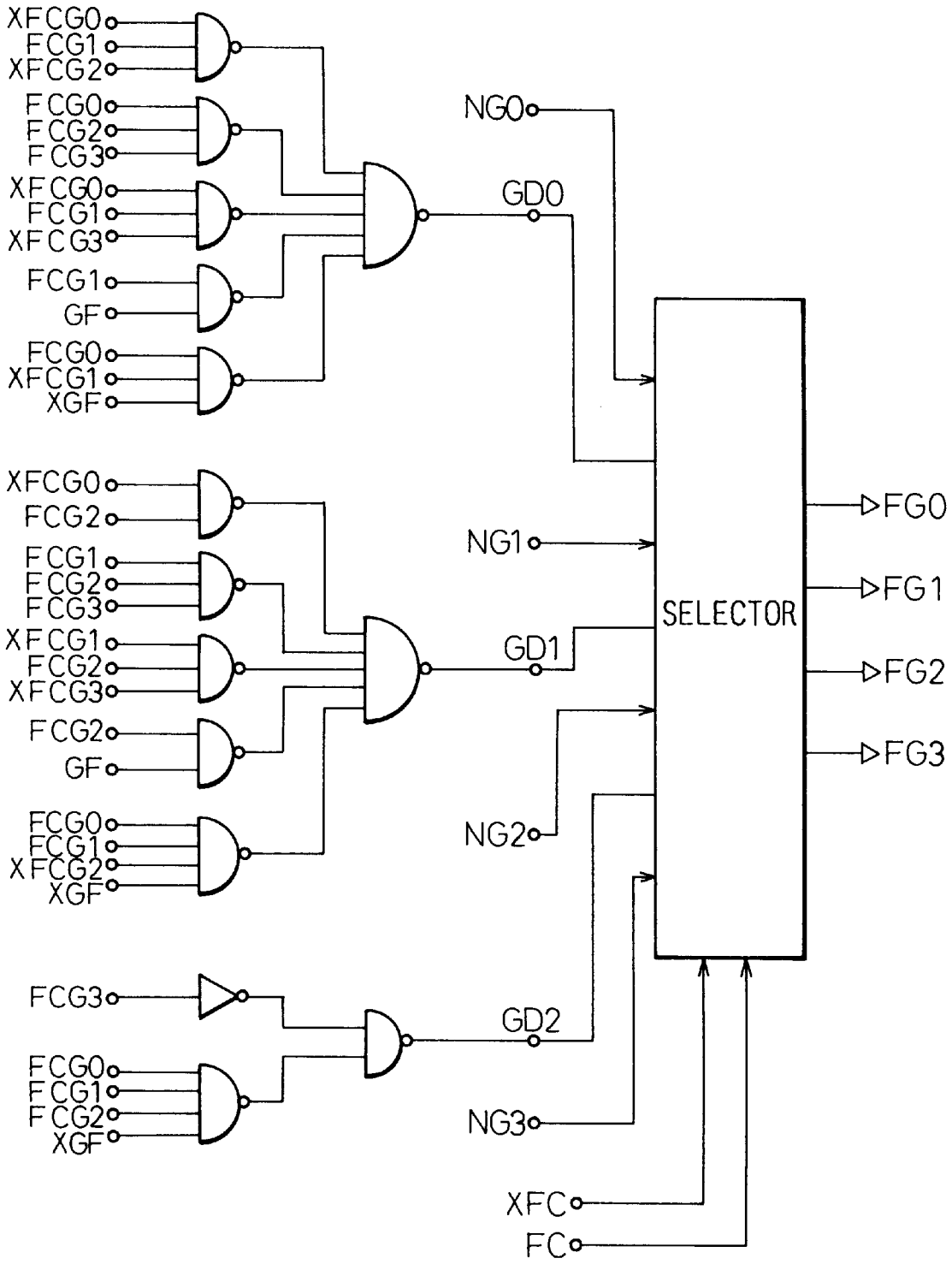
Figure 16V:
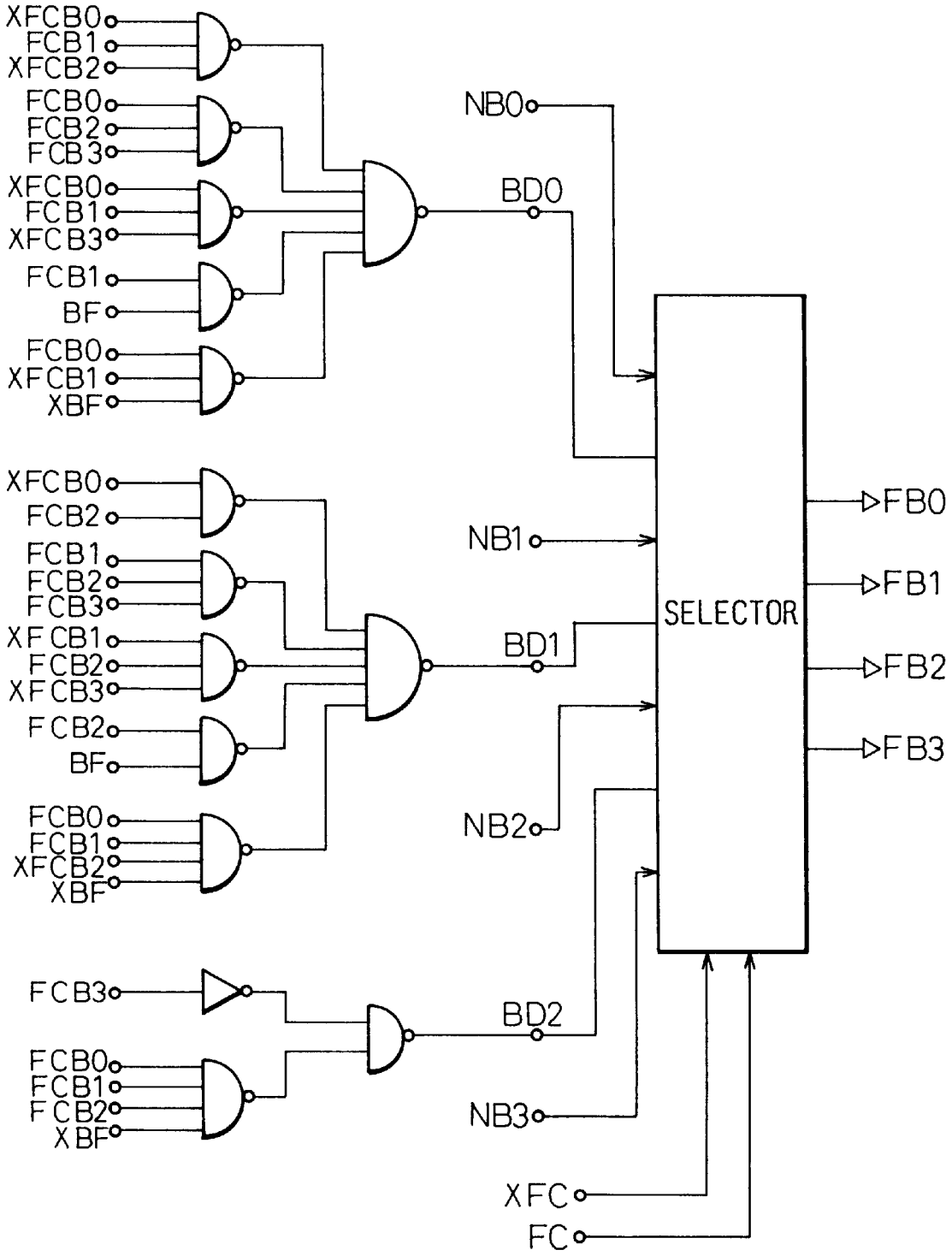

Also, FIG. 16*j* shows a circuit for determining whether a current screen shows an even-number frame or an odd-number frame, and FIG. 16*k* shows a circuit for determining whether a vertical line in a display screen is an even-number line or an odd-number line. Also, a combination of circuits shown in FIGS. 16*e* to 16*g* and 16*p* is comparable to a variant of a display data detecting circuit shown in FIG. 7.

What is claimed is:

1. A driving circuit for driving a liquid-crystal display, using frame modulation, comprising:

a display data detecting circuit for detecting the logical states of at least two adjacent leading dots on the same display line for respective dots in each frame in a cycle specified in display data, said display data detecting circuit-producing results based on whether said leading dots have a predetermined coded state;

a data converting circuit, having at least two averaged patterns for use in averaging brightness during said frame modulation, for selecting a specific averaged pattern from said at least two averaged patterns according to the results of said display data detecting circuit so that one said averaged pattern is selected depending on whether both said leading dots have said coded state, and for converting said display data into frame-modulation data using said selected averaged pattern; and a driver for selecting from at least three voltage levels and applying the selected voltage level to said respective dots of a liquid-crystal panel according to said frame-modulation data converted by said data converting circuit.

2. The driving circuit as set forth in claim 1, wherein said display data detecting circuit detects the logical states of at least two leading dots specified in said display data in response to a horizontal synchronizing signal.

3. The driving circuit as set forth in claim 1, wherein said display data detecting circuit detects the logical states of at least two leading dots specified in said display data and associated with pixels lying on the same display line as the pixels associated with dots currently displayed.

4. The driving circuit as set forth in claim 1, wherein said data whose logical state is detected by said display data detecting circuit is display data concerning two dots each associated with a pixel and composed of red, blue, and green data.

5. The driving circuit as set forth in claim 1, wherein said at least two averaged patterns include a zigzag pattern according to which two adjoining dots in the same direction as a display line have the same gray-scale level and a lateral stripe pattern according to which dots have the same gray-scale level on every other line in the same direction as said display line.

6. The driving circuit as set forth in claim 1, wherein said at least two averaged patterns include a zigzag pattern according to which two adjoining dots in the same direction as a display line have the same gray-scale level and a vertical stripe pattern according to which dots have the same gray-scale level on every other line orthogonal to said display line.

7. A liquid-crystal display using frame modulation, comprising:

a liquid-crystal panel;

a display data detecting circuit for detecting the logical states of at least two adjacent leading dots on the same display line for respective dots in each frame in a cycle specified in input display data, said display data detecting circuit producing a detection signal based on whether said leading dots have a predetermined coded state;

a data converting circuit for frame modulation that converts said input display data into frame-modulation data and supplies said frame-modulation data to said respective dots according to said detection signal; and a driver circuit for selecting from at least three voltage levels and applying the selected voltage level to said respective dots of said liquid-crystal panel according to said supplied frame-modulation data.

8. A method of driving a liquid-crystal display using frame modulation, comprising the steps of:

detecting the logical states of at least the two adjacent leading dots on a display line for respective dots in each frame in a cycle of a liquid-crystal element specified in input display data and supplying a detection signal depending on whether both said leading dots have a predetermined coded state;

converting said input display data into frame-modulation data and supplying said frame-modulation data to said respective dots according to said detection signal; and applying required drive voltages to liquid-crystal display elements by selecting from at least three voltage levels according to said supplied frame-modulation data.

9. The method as set forth in claim 8, wherein said frame-modulation data to be displayed include at least two averaged patterns for use in averaging brightness.

10. The method as set forth in claim 9, wherein said at least two averaged patterns include a zigzag pattern according to which two adjoining dots in the same direction as a display line have the same gray-scale level and a lateral stripe pattern according to which dots have the same gray-scale level on every other line in the same direction as said display line.

11. The method as set forth in claim 9, wherein said at least two averaged patterns include a zigzag pattern according to which two adjoining dots in the same direction as a display line have the same gray-scale level and a vertical stripe pattern according to which dots have the same gray-scale level on every other line orthogonal to said display line.

12. The method as set forth in claim 9, further comprising a step of setting the potential of an opposed electrode in each of pixels arranged in the form of a matrix inside a liquid-crystal panel to a value which reduces an alternating component of a luminance signal relative to a specific gray-scale level.

13. The method as set forth in claim 12, wherein said step of setting the potential of an opposed electrode comprises a sub-step of setting said potential of an opposed electrode to a minimum value relative to a gray-scale level maximizing said alternating component of a luminance signal.

* * * * *